United States Patent [19]

Lebowitz

[11] Patent Number: 4,564,192

[45] Date of Patent: Jan. 14, 1986

[54] MARTIAL ARTS TRAINING APPARATUS AND METHOD

[76] Inventor: Leizer Lebowitz, 2396 Warrensville Center Rd., University Heights, Ohio 44118

[21] Appl. No.: 573,660

[22] Filed: Jan. 25, 1984

[51] Int. Cl.[4] ..... A63B 69/22

[52] U.S. Cl. ..... 272/76; 446/334

[58] Field of Search ..... 272/76, 77, 78; 434/247; 273/29 A, 95 A, 95 AA, 102 AP, 26 R, 26 EA, 26 E; 46/47; 446/334

[56] References Cited

U.S. PATENT DOCUMENTS

| | | | |
|---|---|---|---|
| 2,909,370 | 10/1959 | Fortney | 272/76 |
| 3,804,406 | 4/1974 | Viscone | 272/76 |
| 4,077,624 | 3/1978 | Feaser | 272/76 |

FOREIGN PATENT DOCUMENTS

| | | | |
|---|---|---|---|
| 720044 | 1/1941 | Fed. Rep. of Germany | 272/78 |
| 705216 | 4/1941 | Fed. Rep. of Germany | 272/78 |
| 46210 | 5/1966 | Fed. Rep. of Germany | 272/76 |
| 787434 | 3/1935 | France | 272/78 |

*Primary Examiner*—Richard J. Johnson

*Attorney, Agent, or Firm*—Renner, Otto, Boisselle & Lyon

[57] ABSTRACT

A training apparatus and method for training a martial arts student. A pair of simulated limbs are designed to strike blows against the student in a way that requires great skill on the part of the student to defend against the blows. The blows are directed at the student with considerable force, and from a variety of different angles, thus requiring great dexterity on the part of the student to defend against the blow. The limb members are supported in a way that allows them many degrees of movement. Specifically, the limb members are each connected for universal movement relative to a support. In addition, each of the limb members can pivot relative to the means that connects it for universal movement relative to the support. Still further, the support itself has several degrees of movement to provide additional ranges of movement for the limb members. A spring arrangement resiliently biases the limb members towards a neutral position relative to a student positioned in a striking area. The spring arrangement allows one limb member to recoil relative to the other limb member when a blow is delivered against the one limb member from the striking area. The spring arrangement is designed so that when the one limb member recoils, it applies a resilient follow-up force to the other limb member that causes the other limb member to strike a return blow at a student in the striking area.

15 Claims, 8 Drawing Figures

MARTIAL ARTS TRAINING APPARATUS AND METHOD

BACKGROUND

The present invention relates to an apparatus and method for use in self defense training, particularly martial arts training.

In learning the martial arts, a student must learn to deliver a blow against an opponent, and to effectively block a return blow delivered by the opponent. Often, under real fighting conditions, a return blow is delivered almost instantaneously, and may have even more force than the original blow delivered by the student. Thus, the student must be able to react quickly and effectively to parry the return blow. Furthermore, the return blow may be delivered from almost any angle, and the student must be prepared to meet that return blow no matter where it is delivered from.

In most martial arts training schools, a student must do virtually all of his fight training by actively fighting another student. In fighting with another student, it is difficult to avoid getting hit with relatively hard blows. Consequently, there is a constant danger of injury to the student. The applicant believes that a martial arts training apparatus which can effectively train a student while minimizing the risk of injury to the student can be extremely useful in martial arts training.

Heretofore, there have been some attempts at providing an apparatus that can be used in training a student in the martial arts skills. One such apparatus comprises a series of horizontal posts disposed at various heights relative to a student standing in a striking area, and which posts are designed to be struck by the student. The posts, being relatively rigid, provide little or no recoil or return striking action against the student. Another known type of training apparatus comprises a pair of parallel, horizontal limb members, each of which can pivot about a post. One limb member, when struck by a student, pivots far enough about the post to engage the other limb member and cause the other limb member to pivot, so that the other limb member delivers a return blow at the student. The limb members pivot only in respective horizontal planes, and are supported in such a manner that one limb member must pivot far enough to engage the other limb member before the other limb member can direct a return blow against the student. Finally, an additional training apparatus for martial arts training comprises a single kick member supported from a post by a bellows-like spring. The kick member provides a resilent recoil against a strike.

The foregoing types of training devices have some usefulness in training a martial arts student. However, in the applicant's experience they do not provide realistic enough simulations of real fighting conditions to effectively train the martial arts student. Their ranges of motion are limited, and their responses are well defined, thus making them too predictable to effectively train the martial arts student. Also, they do not provide a way of determining the effectiveness of a student's technique in defending against a return blow. Moreover, they do not effectively take into account the relatively short, explosive type of punch delivered in most martial arts, in comparison to other forms of self defense (e.g. boxing). For example, a martial arts punch might be delivered in the distance of only a few inches, and with no follow-through, so that all of its explosive power (energy) is transferred to the target at the instant of impact. Applicant believes that if a training apparatus dissipates, rather than magnifies, the force of that impact, a return blow delivered by the apparatus may not be delivered with sufficient force to require a student to quickly and effectively defend himself.

SUMMARY

The present invention provides a new and improved training apparatus and method for training a martial arts student. An arrangement of simulated limb members are designed to strike blows against a student in a way that requires great skill on the part of the student to defend against the blows. The blows are directed at a student with considerable force, and from a variety of different angles, thus requiring great dexterity on the part of the student to defend against the blows. At the same time, the parts of the apparatus that strike the student can be heavily padded so that the blows are cushioned and the danger of injury to the student is minimized. Moreover, the method and apparatus of the invention provide a ready indication of an improper technique used by the student in defending against the blows, to help the student in perfecting his defensive techniques.

According to the present invention, a pair of limb members are supported in a way that allows them many degrees of movement. Specifically, the limb members are each connected for universal movement relative to a support. In addition, each of the limb members can pivot relative to the means that connects it for universal movement relative to the support. Still further, the support itself has several degrees of movement to provide additional ranges of movement for the limb members.

A spring arrangement resiliently biases the limb members towards a neutral position relative to a student positioned in a striking area. The spring arrangement allows one limb member to recoil relative to the other limb member when a blow is delivered against the one limb member from the striking area. The spring arrangement is designed so that when the one limb member recoils, it applies a resilient follow-up force to the other limb member that causes the other limb member to strike a return blow at a student in the striking area. The spring arrangment allows movement of the limb members in almost any direction, depending on the manner in which one limb member is struck, and the resolution of forces applied to the other limb member. Thus, the return blow may be struck from a variety of directions, simulating the randomness with which a return blow may be directed against the student. Accordingly, the student must be prepared to defend himself from a return blow struck from almost any angle.

In a particularly unique aspect of this invention, when a blow is struck against one limb member, the return blow delivered by the other limb member may be magnified in force in relation to the force of the blow. Specifically, the limb members are supported in such a way that application of force against one limb member is magnified and causes an increased reaction force to be directed against a student by the other limb member. Thus, even a relatively small blow delivered over a relatively short distance, with little or no follow through causes a significant return blow to be quickly applied against the student, requiring the student to react quickly to define himself against an increased return blow. The limb members are heavily padded, so that even though a return blow is struck with considerable force, the actual impacting force against the student is cushioned, thereby minimizing the danger of injury to the student.

In another unique aspect of this invention, the limb members are supported in such a way that when the return blow is delivered against the student, there will be an indication of whether the student uses proper technique in defending himself against the return blow. Specifically, the universal mounting of the limb members means that when a student uses his arm to defend against a return blow delivered from a limb member, the limb member will deflect from (kind of slip-off) the student's arm, unless the student uses proper technique to defend against the return blow. In fact, if the blow is improperly defended, the limb member may even strike the student in an unintended place (e.g. the head or neck). Thus, an instructor, or the student himself, gets a ready indication when the defensive technique used is improper.

Still further, the apparatus of the invention may be useful not only in training a student to defend himself, but also as a workout device. It allows a student to practice delivering repetitive blows against the limb members, because those limb members will be rapidly returned toward the student after they are struck.

The further features and advantages of the present invention will become further apparent from the following detailed description taken with reference to the accompanying drawings.

DETAILED DESCRIPTION OF THE PREFERRED EMBODIMENT

As discussed above, the present invention relates to a method and apparatus for training a student in the martial arts. The following description relates to the principles of the invention, as they are used in training a martial arts student in arm fighting techniques. Thus, in the preferred embodiment the training apparatus provides a pair of limb members simulating the arms of an opponent. However, with the principles of the invention in mind, it will be clear how the invention can be used in simulating various other types of limb movements.

Figure 7:
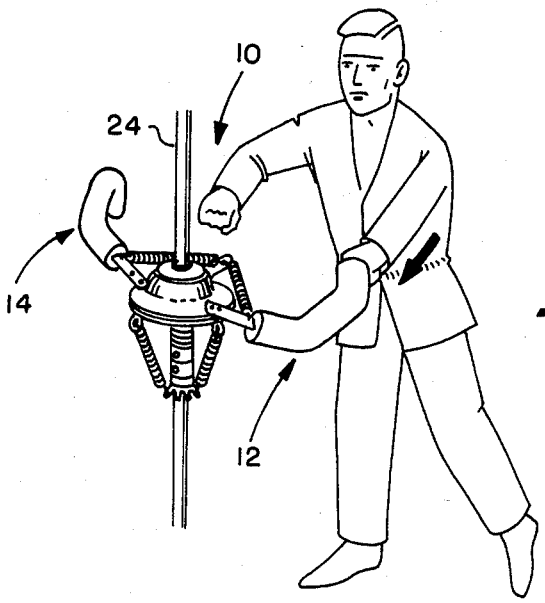
FIG. 7 is a schematic illustration of a student utilizing the apparatus of the invention, showing the student delivering a blow against one of the limb members.
Figure 8:
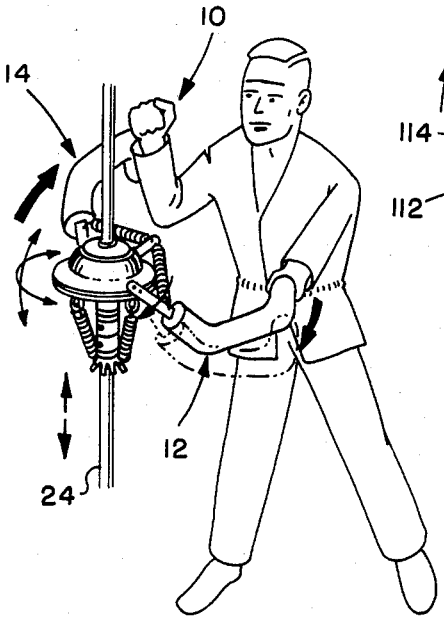
FIG. 8 is a schematic illustration of a return blow being delivered against the student by the other limb member.

FIGS. 7 and 8 schematically illustrate the manner in which a student can train in the martial arts according to the principles of this invention. Initially, the student positions himself in a striking area in which he faces the apparatus of the invention. In FIGS. 7 and 8 the striking area is designated 10. When he is positioned in striking area, the student is facing two simulated arm members 12, 14. The student can deliver a blow against one of the arm members (e.g. arm member 12), and that arm member will recoil relative to the other arm member 14, as illustrated schematically in FIG. 8. Both arm members 12, 14 are mounted for floating, universal type movement, which means that the exact direction of recoil of the arm member 12 may vary, depending on the direction from which the student's blow is delivered. After the arm member 12 recoils, the other arm member 14 delivers a return blow against the student positioned in the striking area 10. The return blow can come from almost any angle, and depends partly on the direction from which the initial blow as struck. For example, viewing FIGS. 7 and 8, if the initial blow is struck in the downward direction, the return blow is likely to be struck from above the student's shoulder, and in a downward direction. That is typical of a fighting situation, because if a student delivers a downward blow against an opponent, it is likely that the student's body will move downward, and a return blow is probably going to be delivered from above the student's shoulder and downward against the student.

As shown in FIG. 8, a return blow is directed against the student positioned in the striking area 10. According to the principles of this invention, the return blow will be struck with a force that is significantly increased over the force with which the student struck. For example, a light blow delivered by the student will result in a return blow with an increased striking force being delivered at the student in the striking area 10. In fact, a blow delivered by a student over a relatively short distance (e.g. a few inches) and with effectively no follow through, will cause a significant return blow to be struck against the student. However, the arm members 12, 14 are heavily padded, so that the actual impact of the return blow against the student is cushioned, thus minimizing the danger of injury to the student.

Additionally, according to the principles of this invention, if the student does not properly parry the return blow, the arm member 14 that delivers the return blow will slip off the arm of the student. Ordinarily, a proper parry of the blow would result in the arm member 14 recoiling under the parry, and transmitting follow-up force back to the arm member 12, so that that arm member 12 in turn delivers another blow at the student. If the student properly defends against that blow, the arm member 12 will recoil, and another blow will be struck by the arm member 14. Thus the student would have to defend himself from blows struck from both sides of the apparatus. If a blow is improperly defended, the arm member delivering the blow will deflect from (slip off) the arm of the student, rather than recoiling under the force of the defense provided by the student. That will disrupt the proper movement of the arm members, and provide a noticeable indication that the return blow has been improperly defined. Furthermore, an improperly parried blow may cause a limb member to be inadvertently deflected in such a direction that it hits the student in the head or neck area, thus emphasizing to the student the importance of using proper defensive technique.

The apparatus according to the preferred embodiment is disclosed in detail in FIGS. 1–6. Preferably, the apparatus includes a support bracket 18 that is secured to the wall 20 of a gym, stand, building, etc. The bracket 18 includes a pair of arms 22 that extend away from the wall and support a vertically extending post 24. Specifically, the ends of the bracket arms 22 have respective openings 26 (FIG. 4), and the vertical post 24 extends through those openings.

Figure 1:
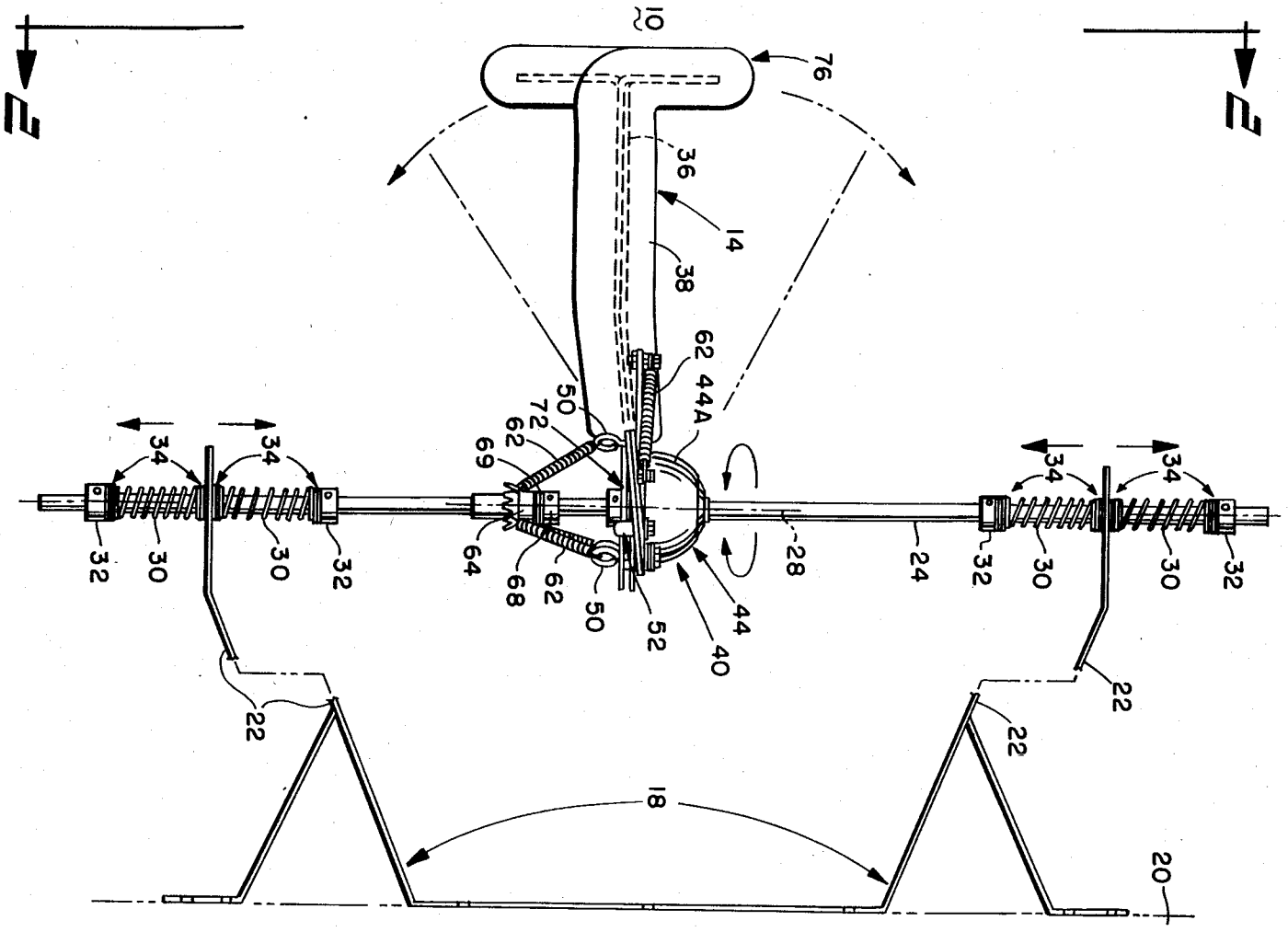
FIG. 1 is a side view of training apparatus constructed according to the principles of this invention.
Figure 2:
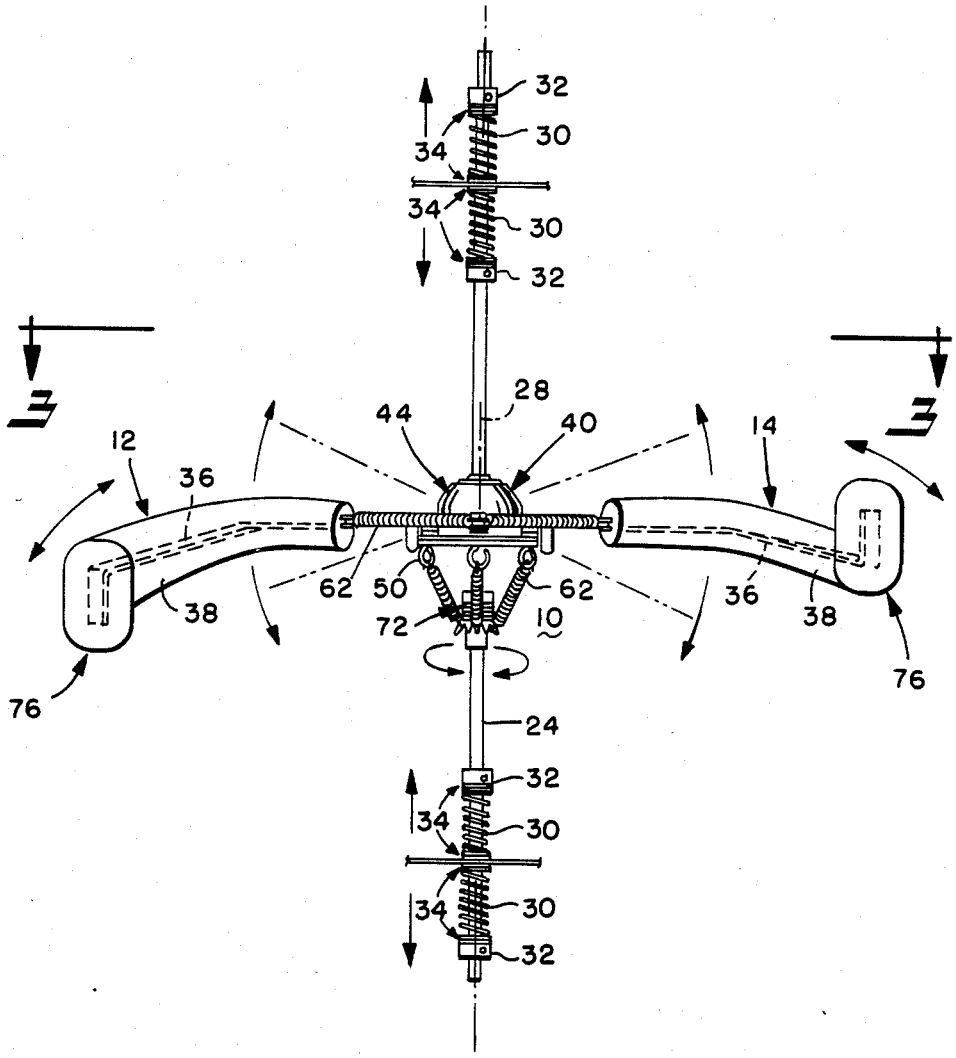
FIG. 2 is a view of the front of the apparatus of FIG. 1, taken from the direction 2—2.
Figure 4:
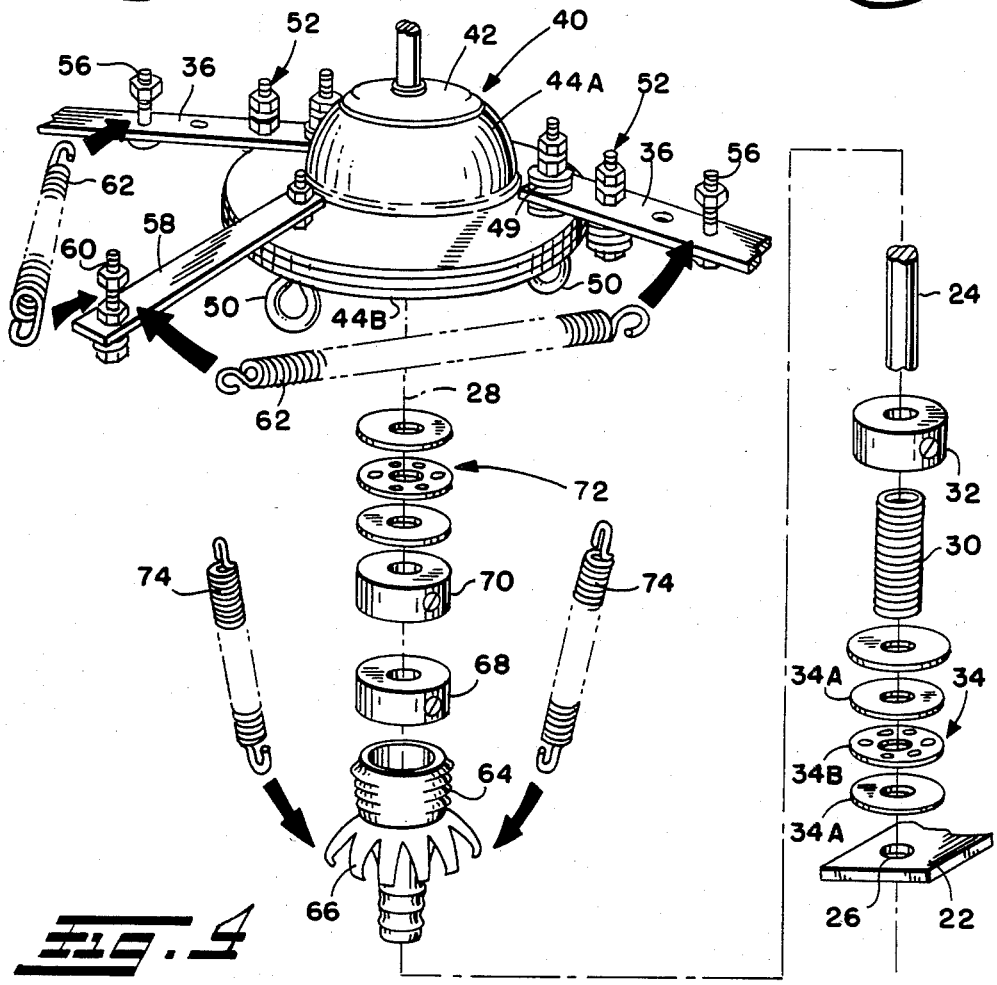
FIG. 4 is a fragmentary, partially exploded, isometric view of the universal coupling mechanism in the training apparatus of FIG. 1.

The post 24 has a central axis 28. The post 24 is supported so that it can rotate about its central axis 28, and can also move axially. Referring to FIGS. 1 and 2, a pair of biasing springs 30 exert equal and opposite forces on the post 24 at each point of attachment to the arms 22. Each spring acts between the arm 22 and a collar 32 fixed to the post 24. Thus, the post 24 can shift axially against the bias of the springs 30. In order to allow the post 24 to freely rotate about its central axis 28, a special bearing washer assembly 34 is disposed between each of the springs 30 and the associated bracket arm 22, and a similar roller bearing washer assembly is also disposed between the spring 30 and the associated collar 32. FIG. 4, at the righthand side, shows an exploded view of one such special roller bearing washer assembly 34. The special roller bearing washer assembly 34 comprises a pair of washers 34A, and a roller bearing washer 34B sandwiched between the pair of washers 34A. The roller bearing washer 34B has a series of roller bearings that allow the post 24 to rotate freely in the bracket arms 22.

The springs 30 bias the post 24 to a neutral position, but allow it to rotate about its axis 28 when a force is applied to the post 24. Further the post 24 can move axially in either direction, against the bias of certain of the springs 30. When the force causing such axial movement is removed, the springs 30 resiliently bias the post 24 to the neutral position shown in FIGS. 1 and 2.

Each of the arm members 12, 14 preferably comprises a bent metal rod 36, surrounded by a padding 38 of relatively soft material. Each of the metal rods 36 is connected with a universal joint 40 which is connected to the post 24, and mounts the arm members 12, 14 for universal movement relative to the post 24.

Figure 3:
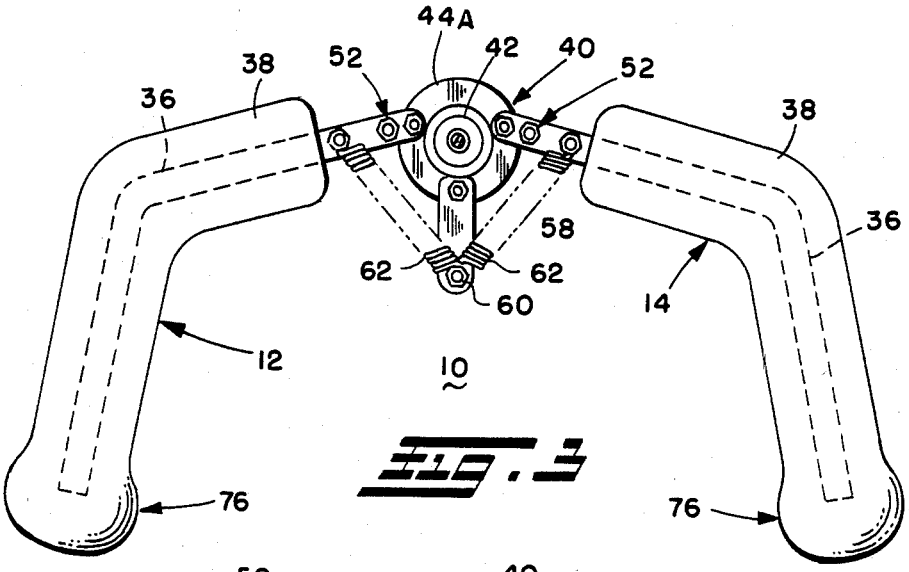
FIG. 3 is a view of the top of the apparatus of FIG. 2, taken from the direction 3—3.

FIG. 3 shows the universal joint 40 connecting the arms 12, 14 to the post 24, and FIG. 4 shows an exploded view of the elements forming the universal joint 40. The universal joint 40 basically comprises a ball 42 and a socket 44. The ball 42 is mounted on the post 24. The socket 44 is preferably formed by a pair of sheet metal members 44A, 44B that are fixedly connected together, and define a spherical jacket surrounding the ball 42. The socket 44 has swiveling, universal type movement relative to the ball 42 and the post 24.

Both arm members 12, 14 are connected with the socket 44 so that they can move universally with it relative to the ball 42 and the post 24. Further, the metal rod 36 of each arm member is pivotally connected to the socket 44, so that each arm member can also pivot relative to the socket. Thus, referring to FIG. 5, a pair of threaded posts 48 extends through aligned holes in the two members 44A, 44B that define the socket. The threaded posts 48 also extend through respective openings in the metal rods 36. A pair of roller bearing assemblies 49, similar to the roller bearing assemblies 34 described above, are disposed on both sides of each metal rod 36. The roller bearing assemblies allow the arm members to pivot freely relative to the socket. The lower end of each threaded post 48 includes a loop 50 for use in supporting a centering spring, as described more fully hereinafter.

Figure 5:
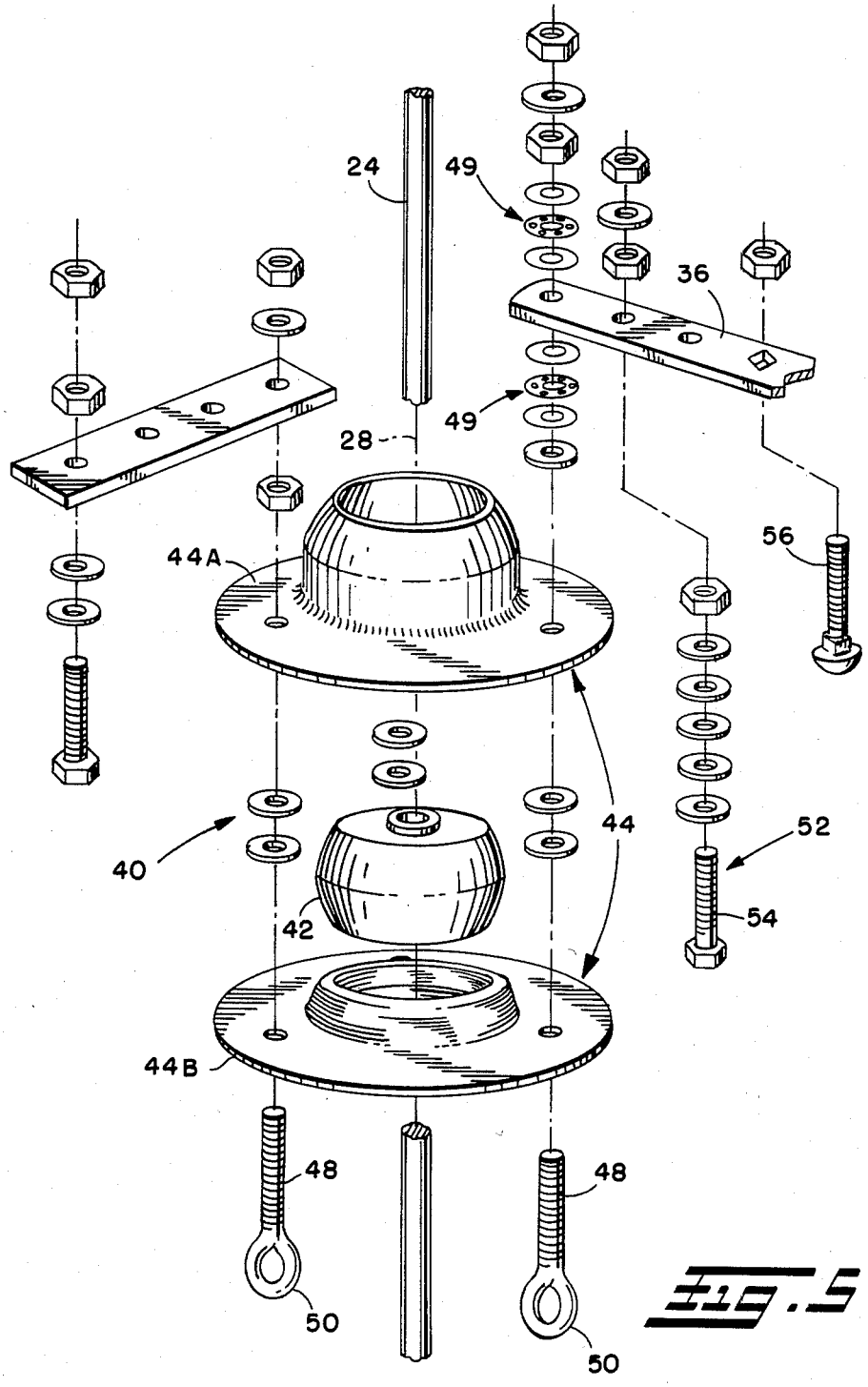
FIG. 5 is an exploded view of the elements of universal coupling mechanism of the training apparatus.
Figure 6:
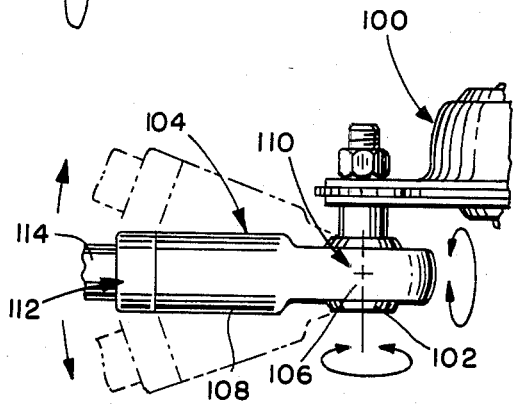
FIG. 6 is a fragmentary isometric view of a modified connection between an arm member and the universal coupling mechanism.

FIG. 6 shows an alternate way of connecting the arm members to the universal coupling. In FIG. 6, the universal coupling is shown at 100, and is identical to the universal coupling 40 of FIGS. 4, 5. A ball 102 is fixed to the universal coupling 100, and an arm member 104 has a socket 106 which surrounds the ball 102, and allows the arm member to move universally about the socket 106. Moreover, the arm member 102 can have a special tubular coupling segment 108 that carries the socket 106 at one end 110 and an internally threaded opening (not shown) at its other end 112. The internally threaded opening can receive an externally threaded end of a shaft 114 forming part of the arm member 104. The use of the threaded tubular coupling segment 108 allows arm members of different lengths to be formed. Further, the provision of the ball and socket connection between the arm member 102 and the universal coupling 100 allows the arm member even an additional degree of freedom than the fixed pivot of the previous embodiment. It is contemplated that with an arm member supported in the manner shown in FIG. 6, an additional spring, located above the arm member, is desirable for preventing the arm member from dropping excessively. The spring would extend between the arm member and another rotatable sleeve surrounding the post, or between the arm member and the universal coupling 100.

On each arm member 12, 14, just outward of the pivot for the arm member, there is a stop mechanism 52. The stop mechanism comprises a threaded pin 54 that is fixedly connected with the arm member by a series of bolts and washers, as shown schematically in FIG. 5. The pin 54 is designed to limit the range of pivoting movement of an arm member when the arm member is recoiling under a blow struck by a student. Additionally, each arm member 12, 14 also includes a post 56 secured to the arm member, outward of the stop mechanism 52. The post 56 forms a connecting surface for a biasing spring, whose structure and function are described more fully hereinafter.

As seen from the fingers, both of the arm members 12, 14 are pivotally supported from the socket 44 in the manner described above. Additionally, between the arm members, toward the front side of the apparatus, is an additional rod 58. The rod is disposed about midway between the pivot points for the arm members 12, 14, and is fixed against movement relative to the socket 44. At the distal end of the rod 58, there is a connection member 60 for engaging a pair of biasing springs 62 that are connected with the arm members.

As seen from FIG. 4, each biasing spring 62 comprises a coil spring that has a hooked end that connects to the post 56 on a respective arm member, and another hook that connects to the connection member 60 on the rod 58. The biasing springs 62 exert light biasing forces on the arm members 12, 14 for biasing the arm members toward a neutral position relative to the universal joint 40. When one arm member is struck by a student in the striking area 10, the biasing spring 62 between that arm member and the rod 58 is initially stretched, as the arm member seeks to pivot relative to the universal joint 40. Also, if the blow is anything but horizontal, the arm member may recoil in an upward or downward direction as the biasing spring 62 associated with that arm member is stretched. When one of the biasing springs 62 is stretched, as the arm member recoils relative to the other arm member, the other biasing spring 62 is placed under great tension. It reacts with a follow-up action, to provide a whiplash like reaction force on the other arm member, urging the other arm member back toward the striking area.

Referring now to FIGS. 2-4, there is a sleeve 64 surrounding the post 24 and disposed just below the universal joint 40. The sleeve 64 can rotate about the post 24, and has a series of hooks 66. There is a collar 68 fixed to the post 24, just above the sleeve 64, and a roller bearing assembly 69 (FIGS. 2, 3), similar to the assembly 34 previously described, is disposed between the collar 68 and the sleeve 64, to enable the sleeve 64 to rotate freely about the post 24. Also, there is another collar 70 (FIGS. 1 and 4) disposed just below the universal joint 40, and another roller bearing assembly 72, similar to assembly 34, disposed between the collar 72 and the universal joint.

A series of centering springs 74 are provided between the rotatable sleeve 64, and the universal joint 40. In the preferred embodiment, there are three centering springs 74 equidistantly spaced about the sleeve 64. The centering springs 74 hook onto the hooks 66 on the sleeve 64, and also onto the loops 50 at the bottoms of the threaded posts 48. The centering springs 74 operate to bias the universal joint 40 toward a centered neutral position, in which the arm members 12, 14 extend in a generally horizontal direction.

FIGS. 1-3 show the apparatus of the invention in the neutral position to which it is biased by the various springs. In that neutral position, the two arm members 12, 14 are biased in a forward position so that they face and extend toward a person in the striking area 10. As shown from FIG. 2, the distal extremities 76 on the arm members 12, 14 may extend in opposite directions (i.e. upward and downward), to simulate the hands of an opponent in opposite orientations. However, the specific direction of the distal extremities 76 of the arm members can be tailored according to the specific type of arm simulation desired, as will be apparent to those of ordinary skill in the art.

As can be seen from FIGS. 1-3, when the arm members 12, 14 are in their neutral position, they have a number of ranges of movement. They can each pivot about the universal joint 40 either universally (FIG. 6) or about an axis (FIGS. 4 and 5). Further, they can pivot universally with the socket 44 relative to the post 24. Moreover, they can pivot with the post 24 about the central axis 28 of the post. Still further, they can shift axially with the post 24 shifts axially.

The extremities 76 of each arm member 12, 14 can be considered one prime target area against which a student positioned in the striking area 10 may deliver a blow against the arm member. Further, different parts of the arm members can also be considered target areas for a student delivering such a blow. However, for the purposes of the following description, it is assumed that the outer extremity of one of the arm members is the initial target area for a student delivering a blow.

When a student positioned in the striking area 10 delivers a blow against the target area of an arm member, the arm member recoils from the source of the blow. The arm member may pivot about the universal joint 40. It may also move upward or downward, unless the blow is purely horizontal. It may turn around the axis 28 of the post, and/or it may shift axially with the post 24, all dependent upon the resolution of forces produced by the particular blow delivered. As the arm member is struck, and recoils under the blow, it tensions certain of the springs, and may compress other springs. For example, it will tension the biasing spring 62 between that arm member and the rod 58. Further, it will cause the biasing spring 62 between the other arm member and the rod 58 to become tensioned. That will cause a whiplash-like, follow-up movement of the other arm member toward the student in the striking area 10. The whiplash action will drive the other arm member toward the student with a force that is increased even over the force with which the first arm member was struck. The centering springs 74 between the universal joint 40 and the rotatable sleeve 64 serve to bias the arm members toward their generally horizontal neutral disposition, and return the arm members toward their neutral position when the striking force is other than horizontal.

Thus, as can be seen from the foregoing discussion, a blow against one of the arm members can make that arm member recoil in almost any direction, depending on the direction and force of the blow struck against it. Initially, that arm member will recoil, and its mounting allows it a considerable degree of freedom as to how it may recoil relative to the other arm member when it is struck. The return blow delivered from the other arm member may be from a variety of angles, depending on the direction of the blow struck against the first arm member, and the resolution of forces on the other arm that cause it to deliver its return blow. The various degrees of freedom of the arm members, and the different resolutions of forces that can act between the arm members heightens the unpredictability of the movement of the arm members.

In training with the apparatus, the student initially positions himself in striking area 10. He then delivers a blow against one arm member, as shown schematically in FIG. 7. The blow may be delivered over a relatively short distance, and without a follow-through, as is typical in most martial arts training disciplines. The arm member that is struck will recoil and cause a follow-up return blow to be struck by the other arm against the student, as shown schematically in FIG. 8. If the student correctly parries the return blow, the arm member which delivered that return blow will recoil and cause the first arm member to strike a further blow at the student. The arm members, if correctly parried, will continue to strike blows at the student, requiring the student to defend against the blows. The direction of the return blows will be somewhat unpredictable because of (i) the many degrees of freedom of the arm members, and (ii) the different spring forces that can act between the arm members. Thus, the student must exhibit great dexterity in parrying the blows.

Still further, with the principles of this invention, the apparatus is useful not only in simply delivering a series of blows against a student, but also in providing the student (and/or an instructor) with an indication of when an improper defensive technique has been used by the student to block or parry a blow. Specifically, in the event that a student improperly blocks a blow, the universal mounting of the arm members, and the spring connections described above, will result in the arm member which is not correctly blocked deflecting the student's arm rather than being effectively parried. The arm member may even hit the student in the head or neck area. The result is that the student or an instructor will get a ready indication of an improper defense, thus enabling the student to work at improving his defensive techniques.

Moreover, the particular arm mounting and spring arrangement described above have been found to produce an increased return force delivered by one arm member over the force of the blow delivered by the student against the other arm member. Thus, a relatively light blow against one of the arm members results in an increased reaction force delivered by the other arm member, requiring the student to defend against the increased return blow. This is very useful because, in the real world, a student may well find himself having to defend against a return blow of a magnitude that is significantly increased over the blow delivered by the student. Of course, the padding 38 provided on the arm members 12, 14 means that the actual impact force delivered by an arm member against the student is cushioned, so that the danger of actual injury to the student is minimized.

Still further, while the preferred form of this invention contemplates providing a training apparatus for allowing a student to defend against blows from both sides, the apparatus described above can also be used to simply provide a student with a work-out mechanism. For example, the student could simultaneously deliver blows against both arm members, similar to the way a boxer might work out with a punching bag. In that case, both arm members would recoil and would both return toward the student, at which time they could be struck again by the student. Thus, a student may use the apparatus of the invention to simply work out.

Of course, while the preferred embodiment provides a pair of simulated arm members, the principles of this invention are equally applicable to other forms of limb members. For example, the principles of the invention can be used to provide simulated legs. Moreover, they can be used to provide a simulated arm and a simulated leg.

Thus according to the present invention applicant has provided what is believed to be a new and useful method and apparatus for use in martial arts training. With the foregoing disclosure in mind it is believed that various types of martial arts training devices and methods, utilizing the principles of this invention, will become readily apparent to those of ordinary skill in the art.

I claim:

1. Training apparatus comprising support means, a pair of limb members connected with said support means and being adapted for universal movement relative to said support means, said limb members being yieldably and resiliently interconnected with each other in a manner that allows one limb member a range of movement relative to the other limb member in response to an external impact on the one limb member and causes a reaction force to be applied to the other limb member to cause follow-up movement of the other limb member when the one limb member is caused to move by an external impact, said support means comprising an axially extending post, universal coupling means for connecting each of said limbs to said post for universal movement relative to said post, said post being supported for rotation about its central axis and being supported for limited axial movement, to allow rotational and axial movement of said limb members along with said post, means for pivotally coupling each limb member to the universal coupling means so that each limb member can pivot relative to the universal coupling means that couples the limb member with the post, said spring means biasing each arm member to a neutral position, said universal coupling means comprising a ball connected to said post, and a socket coupled to said ball having universal movement relative to said ball, and each of said limb members being pivotally secured to said socket to allow each limb member to pivot relative to said socket, and to move universally with said socket relative to said ball.

2. Training apparatus as defined in claim 1 including centering spring means coupled with said post and said universal coupling means, said centering spring means biasing both limb members to a common, substantially horizontal plane.

3. Training apparatus as defined in claim 2 wherein a sleeve is rotatable on said post, said centering spring means acting between said socket and said sleeve, and biasing said socket to a position in which said limb members are in said common, substantially horizontal plane.

4. Training apparatus as defined in claim 3 including an intermediate post member fixed to the socket, said intermediate post member extending outward from the socket, said first biasing spring means acting between the intermediate post member and said one arm member and said second spring means acting between the intermediate post member and the other arm member.

5. Training apparatus as defined in claim 4 including a bearing assembly disposed between each arm member and the socket, each bearing assembly comprising a pair of spaced-apart washers and a roller bearing washer disposed between and in rolling engagement with the spaced-apart washers.

6. Training apparatus as defined in claim 5 including bearing means between said rotatable collar and said post, said bearing means comprising a pair of spaced-apart washers and a roller bearing washer disposed between said spaced-apart washers.

7. Training apparatus as defined in claim 6 wherein said post is movable axially relative to said support, said post being rotatably mounted in said support, and spring means biasing said post to a predetermined axial position, said post being movable against said spring means in either axial direction, and bearing means disposed between said post and said support, said bearing means comprising a pair of spaced-apart washers and a roller bearing washer disposed between said spaced-apart washers.

8. Training apparatus comprising support means, a pair of limb members connected with said support means and being adapted for universal movement relative to said support means, said limb members being yieldably and resiliently interconnected with each other in a manner that allows one limb member a range of movement relative to the other limb member in response to an external impact on the one limb member and causes a reaction force to be applied to the other limb member to cause follow-up movement of the other limb member when the one limb member is caused to move by an external impact, spring means acting between said limb members and operative to resiliently deform when one limb member is impacted to allow the one limb member to initially move relative to the other limb member and then to impart follow-up movement to the other limb member.

9. Training apparatus as defined in claim 8 wherein said support means comprises an axially extending post, universal coupling means for connecting each of said limbs to said post for universal movement relative to said post, said post being supported for rotation about its central axis and being supported for limited axial movement, to allow rotational and axial movement of said limb members along with said post.

10. Training apparatus as defined in claim 9 including means for pivotally coupling each limb member to the universal coupling means so that each limb member can pivot relative to the universal coupling means that couples the limb member with the post, said spring means biasing each arm member to a neutral position.

11. Training apparatus as defined in claim 10 wherein said spring means for exerting resilient biasing force between the limb members comprises first biasing spring means acting between one limb member and the universal coupling means, and second biasing spring means acting between the other limb member and the universal coupling means.

12. Apparatus for use in self defense training, comprising a pair of limb members biased toward a neutral position relative to a striking area, means supporting each limb member for universal movement relative to said neutral position in the event of an external impact delivered against the limb member from the striking area, said limb members being connected with each other in a manner that allows a degree of movement of one limb member relative to the other limb member, spring means acting between limb members and operative to resiliently deform when one limb member is impacted from the strike area to allow the one limb member to initially move relative to the other limb member and then to impart follow-up movement to the other limb member, the follow-up movement urging said other limb member toward the strike area.

13. Apparatus as defined in claim 12 wherein each limb member can move universally relative to the other limb member in response to an external impact against said one limb member from the strike area.

14. Apparatus as defined in claim 13 wherein said spring means biases said limb members to said neutral position, said spring means imparting said follow-up movement to said other limb member in response to said degree of movement of said one limb member.

15. A method of self defense training for a person positioned in a striking area comprising the steps of providing a pair of limb members positioned relative to the striking area, each of the limb members disposed to receive an external impact thereon, moving one of the limb members with a universal range of motion relative to the other limb member in response to an impact delivered against the one limb member from a person in the striking area, elastically absorbing the energy of the impact against the one limb member to allow the one limb member to move relative to the other limb member, and transferring a portion of the absorbed elastic energy to the other limb member to impart resilient follow-up movement to the other limb member in response to movement of the one limb member, the follow-up movement causing the other limb member to deliver a blow against the person in the striking area.

* * * * *